United States Patent [19]

Gust et al.

[11] 4,089,122

[45] May 16, 1978

[54] NOISE ATTENUATION DURING STEAM BLOWING OF COATED TUBES

[75] Inventors: Karl Gust, Mettmann; Albert Hankel, Kettwig; Horst Hasenclever, Oberhausen; Eberhard Titze, Ratingen, all of Germany

[73] Assignee: Mannesmannrohren-Werke AG., Dusseldorf, Germany

[21] Appl. No.: 613,848

[22] Filed: Sep. 16, 1975

[30] Foreign Application Priority Data

Sep. 17, 1974 Germany ..... 2444944

[51] Int. Cl.[2] ..... F26B 21/06

[52] U.S. Cl. ..... 34/79; 34/80; 34/82; 15/304; 15/316 R; 181/262; 118/61; 134/104

[58] Field of Search ..... 34/79–82; 118/58, 61, 63; 15/304, 316 R, 406; 134/104, 109, 166 C, 167 C, 168 C, 169 C; 181/33 K, 43, 36 C, 36 D

[56] References Cited

U.S. PATENT DOCUMENTS

| | | | |
|---|---|---|---|
| 1,121,192 | 12/1914 | Lumb | 15/316 R |
| 2,470,228 | 5/1949 | Aksomitas | 15/406 |
| 2,548,563 | 4/1951 | Smith | 181/43 |
| 3,205,588 | 9/1965 | Oetjen et al. | 34/82 |

*Primary Examiner*—John J. Camby
*Assistant Examiner*—Henry C. Yuen
*Attorney, Agent, or Firm*—Ralf H. Siegemund

[57] ABSTRACT

Zinc coated tubes are cleaned by means of steam, and the zinc residue — steam mixture is blown into a nozzle which is heated, and discharged into a noise attenuation chamber; the latter discharges into an expansion chamber, which in turn discharges into a filter. The mixture is diluted in the attenuation chamber by air sucked in from the outside along a tortuous path.

15 Claims, 2 Drawing Figures

NOISE ATTENUATION DURING STEAM BLOWING OF COATED TUBES

BACKGROUND OF THE INVENTION

The present invention relates to noise attenuation during blowing steam through tubes which have been coated with a material such as zinc.

After tubes or pipes have been, for example, zinc-coated or plated, particularly on the inside, they are taken from the respective bath and it becomes necessary to remove any residue from the interior that does not adhere and is not a part of the coating. For this it is common practice to blow steam through the pipes or tubes at a pressure of at the most 16 atmospheres. This blowing process is very noisy, the noise level rising to 130 db, which is objectionable to say the least.

DESCRIPTION OF THE INVENTION

It is an object of the present invention to provide for blowing of coated tubes without damage to the coating and without incurring unduly high noise levels.

In accordance with the preferred embodiment of the invention, it is suggested to blow the steam-coating material (residue) mixture into a sound attenuating chamber, from which the mixture flows into an expansion chamber, and from there through a filtering device. Preferably, the mixture is heated when passing through the sound attenuation chamber as well as during expansion. Particularly, heated air is fed into the attenuation chamber and having a temperature in excess of the solidification temperature of the coating material as entrained in the steam. In the case of zinc that requires a temperature in excess of 420° C.

The sound attenuation chamber is preferably provided with a funnel-shaped entrance continuing in a cylindrical passage-way that leads into the interior of the sound attenuation chamber and has the same diameter as the tube. The passage-way is heated by air flowing through ducts surrounding the passage way, and into the chamber interior. The sound attenuation chamber is movably disposed to move towards and away from the tube end through which the steam discharges. The sound attentuation chamber receives additionally diluting air through a cross-section of inflow similar to the cross-section of the tube.

The expansion chamber serves preferably as a baffle to remove large size residue entrained in the steam and the filter provides further cleaning of the steam from zinc residue.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding now to the detailed description of the drawing, FIG. 1 shows a tube 7 on a magnetic roller track 6. It is presumed that tube 7 has been placed into a zinc bath and removed therefrom following completion of the zinc coating process. Pursuant to that removal, the tube 7 was placed into a horizontal disposition onto the track 6, but is magnetically held thereon in a fixed position.

Figure 1:
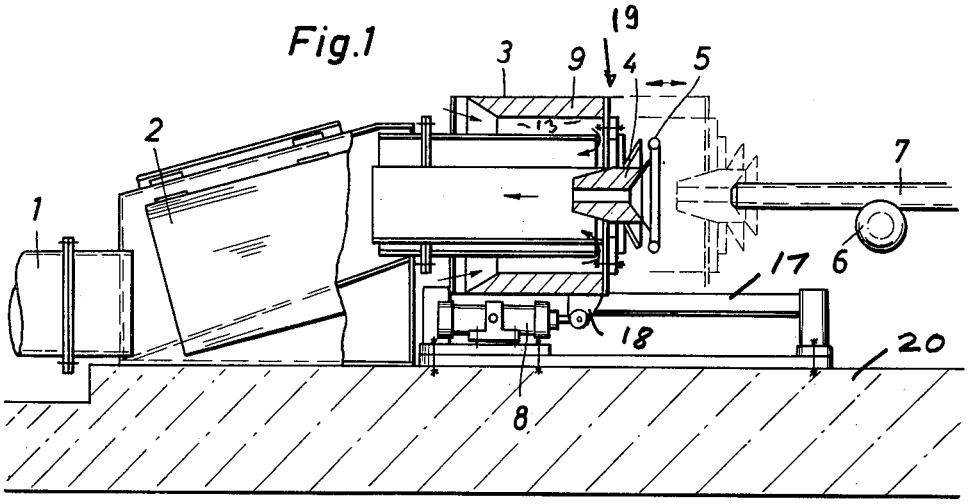
FIG. 1 is a longitudinal section through a device in accordance with the preferred embodiment of the invention.

The tube has, of course, two ends and a chamber, such as 3 is now moved into position as indicated by dashed lines. The other end of the tube (not shown) is connected to a steam blowing valve connected to a source for pressurized steam. Conceivably, the steam charge equipment may be covered by or inserted in a sound attenuation chamber. Before continuing with the description of the operational sequence, the devices associated with chamber 3 shall be described.

The entire arrangement, including roller track or bed 6 are disposed on a foundation or base 20 and a rail equipment 17 is provided for a carriage 18 which rides on that rail equipment 17 while being driven by a hydraulic motor 8. This device 8 is needed to provide for the necessary pressure by means of which chamber 3 is forced against the illustrated end of tube 7.

The sound attenuation chamber 3 has a thick cylindrical, tubular jacket 9 made of or containing sound attenuation substances, such as spongy or foamy material, which must be sufficiently temperature-resistant as far as the operating temperatures are concerned. The one axial front of tube member 9 is closed by a plate structure 19, which holds a nozzle member 4 to be described shortly.

A labyrinth structure 13, inside of tube 9 and affixed to front plate structure 19 provides for a tortuous path for ambient air which enters chamber 3 from the axial end opposite to front plate structure 19, and flows ultimately from around the portion of nozzle member 4, which projects into the interior of structure 13, into the inner flow path of the latter into which nozzle 4 likewise discharges. The cross-section of flow of such air corresponds to the cross-section of the tube 7 to be cleaned. Some of the air that enters structure 13 discharges without reaching the innermost portion of structure 13. Thus, the air as sucked into the chamber 3 provides for stepwise dilution of the steam-zinc mixture as discharged through nozzle 4.

Figure 2:
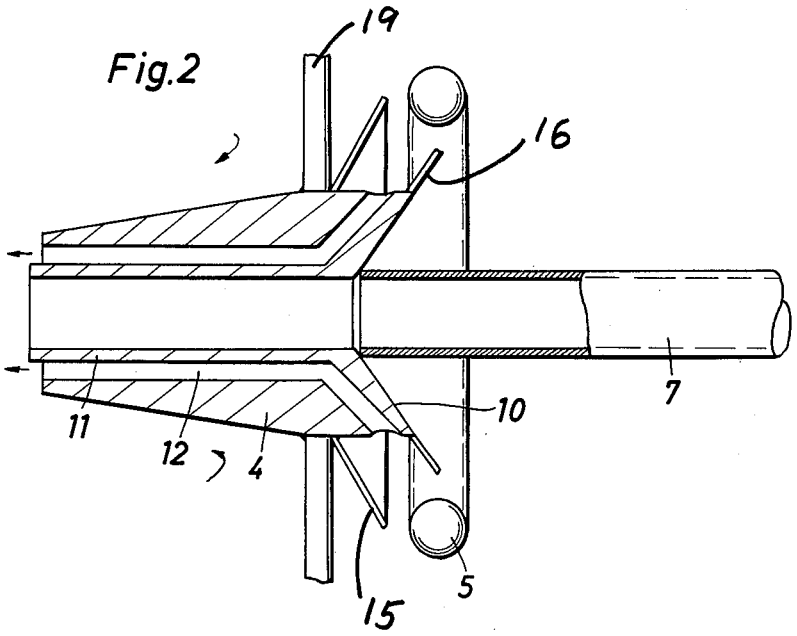
FIG. 2 is an enlargement of a detail of FIG. 1.

The nozzle member 4, depicted in greater detail in FIG. 2 has a concave-conical entrance portion 10 which continues in an inner passage way and discharge duct 11. The member having duct 11 has axial bores or ducts 12, which are uniformly arranged around duct 11 and terminate inside of structure 13. The ducts 12 have entrance portions in the funnel-shaped portion 10 of nozzle member 4, but the entrance openings of ducts 12 are covered laterally by two funnel-like members 15 and 16. The annular gap between the funnel member 15 and 16 is partially covered by an annular burner 5, so that air entering the space between members 15 and 16 and being sucked into ducts 12 is heated. The air is heated sufficiently so that the walls of duct 11 are heated to a temperature in excess of the solidification temperature of zinc which is about 420° C.

The nozzle member 4 may be exchangeable and the particular one used has a duct 11, whose diameter corresponds to the diameter of the tube 7 to be cleaned and discharged. Also, the length of duct 11 particularly as far as its penetration into the interior of chamber 3 is concerned, is proportional to the diameter of the tube to place the expansion point of the steam-zinc mixture as far as possible remote from the tube end 7 and to ensure uniformity of flow. The precipitation of zinc is to be avoided, which is the reason for heating the walls of ducts 11. Also, the dilution air fed through the labyrinth structure could be heated.

The one axial end of labyrinth structure 13 is telescoped into the entrance of an expansion chamber 2 which in turn connects to a bag filter of which only entrance 1 is shown. Expansion chamber 2 is inclined so that the filter entrance 1 is offset to the direction of discharge of the zinc-steam mixture by nozzle 4. This way chamber 2 acts as a baffle to remove larger entrained zinc droplets from the flow.

In operation, drive 8 moves carriage 18, so that the funnel-shaped entrance 10 of nozzle member 4 is forced against the one end of tube 7. The movability of the attenuation chamber 3 with nozzle 4 permits ready adaptation to different tube lengths. Also, the tube does not have to be very accurately positioned on track 6 as far as this discharge structure (4,10 etc) is concerned. The engagement between entrance cone 10 and tube 7 is an annular one, but due to the oblique surface portions of entrance 10, one avoids engagement thereof with the zinc layer on tube 7, which layer has not yet solidified.

Now steam is blown through tube 7 from the other end, and a zinc-steam mixture is blown into nozzle 4, particularly through duct 11. Since the duct is heated to a temperature in excess of the zinc solidification temperature, zinc will not deposit into duct 11. The nozzle duct 11 projects quite far into chamber 3 and determines the flow. Also, the point of expansion is removed as far as possible from the end of tube 7.

The expansion is limited at first by the flow of air into chamber 3 through labyrinth structure 13 and also by the discharge of heating air from ducts 12 into the interior of 13-3, through which flows the zinc-steam mixture. The labyrinth structure 13, as far as access to ambient air is concerned, and the sound attenuation wall 9 impede significantly the emanation of noise particularly as resulting from the discharge of zinc-steam by nozzle 4.

The zinc-steam mixture flows at quite a high speed, and the expansion chamber 2, which is obliquely positioned, serves as a baffle to remove larger zinc particles, droplets and globules as entrained in the steam. The air that is added in chamber 3 by labyrinth structure 13 dilutes the steam-air mixture to avoid dropping of the temperature below the effective dew point, particularly in filter 1. The further dilution in chamber 2 serves the same purpose, i.e. the steam zinc mixture is stepwise diluted with air. The air fed to chambers 3 and 2 is in parts heated by virtue of the heater 5 as heating air discharges through ducts 12. However as stated above, the air entering chamber 3 along the tortuous path of labyrinth structure 13 may be heated additionally.

The filter 1 is constructed, for example, as a bag filter and removes the lighter components of the zinc-steam mixture, and zinc particularly precipitates herein. As stated, the removed larger particles (droplets) were already collected in expansion chamber 2.

Following the cleaning of tube 7, carriage 18 is retracted to release tube 7, which can now be removed.

The invention is not limited to the embodiments described above, but all changes and modifications thereof not constituting departures from the spirit and scope of the invention are intended to be included.

We claim:

1. In a device for blowing plated tubes by means of steam for purposes of cleaning the interior of such a tube from residue of th plating material, comprising:
   first means defining a noise attentuation chamber with entrance to be placed in engagement with one end of the tube through which the blown steam discharges;
   second means defining an expansion chamber disposed in relation to the noise attenuation chamber to receive therefrom the steam for collecting larger particles in the steam; and
   filter means connected to the means defining an expansion chamber to clean said steam.

2. In a device as in claim 1 and including fourth means for heating the steam in the attenuation chamber.

3. In a device as in claim 2, wherein the fourth means include a heater and means for conducting air as heated by the heater into the interior of the attenuation chamber.

4. In a device as in claim 1 and including means for diluting the steam in the noise attenuation chamber.

5. In a device as in claim 4, the means for diluting including air passage-ways into the attenuation chamber at a cross-section adapted to correspond to the cross-section of the tube.

6. In a device as in claim 1, the first means including a receiver nozzle with funnel-shaped entrance and a passage-way terminating in the interior of the attenuation chamber.

7. In a device as in claim 6, said passageway having the same inner diameter as the tube.

8. In a device as in claim 6, the passageway being surrounded by ducts for feeding air into the said interior.

9. In a device as in claim 8, said ducts being annularly arranged around said passage-way.

10. In a device as in claim 8 and including heating means in front of the duct to heat the air which in turn heats the passage-way to a temperature in excess of the solidifying temperature of the plating material entrained in the steam as blown.

11. In a device as in claim 1, said first means being movably disposed for moving towards and away from said tube end.

12. In a device as in claim 1, said first means including a sound absorbing wall circumscribing the interior of the attenuation chamber.

13. In a device as in claim 1, wherein said second means is constructed for baffle action to remove larger size residue as entrained from the steam.

14. In a device as in claim 1, said first means including a labyrinth structure for sucking air into its interior for diluting the steam as discharged from the tube.

15. In a device as in claim 14, the cross-section of said labyrinth structure as sucking air having the same area as the cross-section of the tube.

* * * * *